US008426755B2

(12) United States Patent
Nogami

(10) Patent No.: US 8,426,755 B2
(45) Date of Patent: Apr. 23, 2013

(54) INPUT DEVICE WITH DRAINAGE

(75) Inventor: Shin_ichi Nogami, Ibaraki (JP)

(73) Assignee: Clarion Co., Ltd., Tokyo (JP)

( * ) Notice: Subject to any disclaimer, the term of this patent is extended or adjusted under 35 U.S.C. 154(b) by 281 days.

(21) Appl. No.: 12/795,850

(22) Filed: Jun. 8, 2010

(65) Prior Publication Data

US 2010/0307896 A1 Dec. 9, 2010

(30) Foreign Application Priority Data

Jun. 8, 2009 (JP) ..... 2009-136930

(51) Int. Cl.
*H01H 9/04* (2006.01)

(52) U.S. Cl.
USPC ..... 200/302.1

(58) Field of Classification Search ..... 200/293, 200/302.1; *H01H 19/06, 9/04*
See application file for complete search history.

(56) References Cited

U.S. PATENT DOCUMENTS

| | | | | |
|---|---|---|---|---|
| 3,172,981 | A | 3/1965 | Loesch | |
| 4,308,434 | A | 12/1981 | Roeser | |
| 4,482,791 | A | 11/1984 | Rendgen | |
| 4,877,930 | A | 10/1989 | Fukuma | |
| 4,897,516 | A | 1/1990 | Wakatsuki | |
| 4,968,862 | A | 11/1990 | Maeda | |
| 5,117,074 | A | 5/1992 | Yanai et al. | |
| 5,412,165 | A | 5/1995 | Malone et al. | |
| 5,421,659 | A | 6/1995 | Liang | |
| 5,453,589 | A | 9/1995 | Mayer | |
| 5,753,874 | A | 5/1998 | Kossakowski | |
| 5,760,356 | A | 6/1998 | Garcia et al. | |
| 6,717,082 | B1 | 4/2004 | Wu | |
| 7,230,195 | B2 * | 6/2007 | Ohnishi | 200/302.1 |
| 7,294,800 | B2 * | 11/2007 | Koyama | 200/302.1 |
| 2003/0024795 | A1 | 2/2003 | Suzuki | |
| 2005/0011736 | A1 | 1/2005 | Mori et al. | |
| 2009/0154133 | A1 * | 6/2009 | Choi | 361/812 |

FOREIGN PATENT DOCUMENTS

| | | | |
|---|---|---|---|
| EP | 1552985 | A1 | 7/2005 |
| JP | 2002-279851 | A | 9/2002 |
| JP | 2006-331917 | | 12/2006 |
| WO | 01/70507 | A1 | 9/2001 |

OTHER PUBLICATIONS

European Search Report dated Sep. 23, 2010.
European Search Report dated Oct. 13, 2010.
U.S. Office Action dated Apr. 25, 2012 recieved in U.S. Appl. No. 12/813,967.

* cited by examiner

*Primary Examiner* — Vanessa Girardi
(74) *Attorney, Agent, or Firm* — Scully, Scott, Murphy & Presser, P.C.

(57) ABSTRACT

A technique of preventing permeation of liquid and dust to electronic parts within a housing of an input device for an in-vehicle device.

An input device of an in-vehicle device comprises a housing that stores a substrate and an operating member that passes through the housing from a side of the substrate and is exposed to outside. A first drain hole is formed in the housing at a position corresponding to a gap between the housing and the operating member. The first drain hole is coupled with a drainpipe, which passes through the substrate to the back side of the substrate.

6 Claims, 8 Drawing Sheets

INPUT DEVICE WITH DRAINAGE

INCORPORATION BY REFERENCE

This application claims priority based on a Japanese patent application, No. 2009-136930 filed on Jun. 8, 2009, the entire contents of which are incorporated herein by reference.

BACKGROUND OF THE INVENTION

The present invention relates to an input device for operating an in-vehicle device such as a navigation system, an air-conditioning system, or an audio system.

As an input device for an in-vehicle device, known is an input device comprising: an input sensing element for detecting a plurality of operations such as directing, turning and pushing-down; an operating knob connected to that input sensing element; input sensing elements each for detecting push-down operation; and push buttons connected to those input sensing elements (See Patent Document 1, for example).

Patent Document 1: Japanese Un-examined Patent Application Laid-Open No. 2006-331917

SUMMARY OF THE INVENTION

Sometimes such an input device for an in-vehicle device goes wrong when liquid (such as water or coffee spilled by a user of the input device) or dust permeates a gap (such as a gap between buttons or a gap between the operating knob and a button) existing in the operation surface in which the operating knob and the push buttons are arranged, since such liquid or dust may reach electronic parts such as an input sensing element or a circuit inside the housing. For example, if an input device is installed between two front seats in a vehicle in such a way that its operation surface faces toward the ceiling of the vehicle, liquid or dust easily falls upon the operation surface and thus there is a high probability that a failure occurs.

An object of the present invention is to provide a technique of preventing permeation of liquid and dust to electronic parts inside a housing of an input device for an in-vehicle device.

To solve the above-mentioned problem, one aspect of the present invention provides an input device for an in-vehicle device, wherein: the input device comprises; a housing that stores a substrate; and an operating member that passes through the housing from a side of the substrate and is exposed to outside; the housing is provided with a first drain hole at a position corresponding to a position of a gap between the housing and the operating member; the first drain hole is coupled with a drainpipe; and the drainpipe passes through the substrate to a back side of the substrate.

Here, in the above-mentioned input device, the housing may be provided, in the back side of the substrate, with a second drain hole leading to the outside. Further, in one of the above-described input devices, the housing may be provided with a drain at a position corresponding to the position of the gap between the housing and the operating member, and the first drain hole may be formed in a bottom of the drain.

Further, in the above-described input device, the first drain hole may be formed in the bottom of the drain at a position that becomes lower when the input device is installed such that a top side of the input device is inclined at a prescribed angle. Further, in the above-described input device, the housing may have at least two first drain holes, and at least one of the first drain hole may be formed in the bottom of the drain at a position that becomes lower when the input device is installed such that the top side of the input device is inclined at the prescribed angle.

According to the present invention, in an input device for an in-vehicle device, it is possible to prevent permeation of liquid and dust to electronic parts within the housing more effectively. Thus, it is possible to reduce the probability of failure occurrence due to liquid or dust.

DETAILED DESCRIPTION

Figure 1:
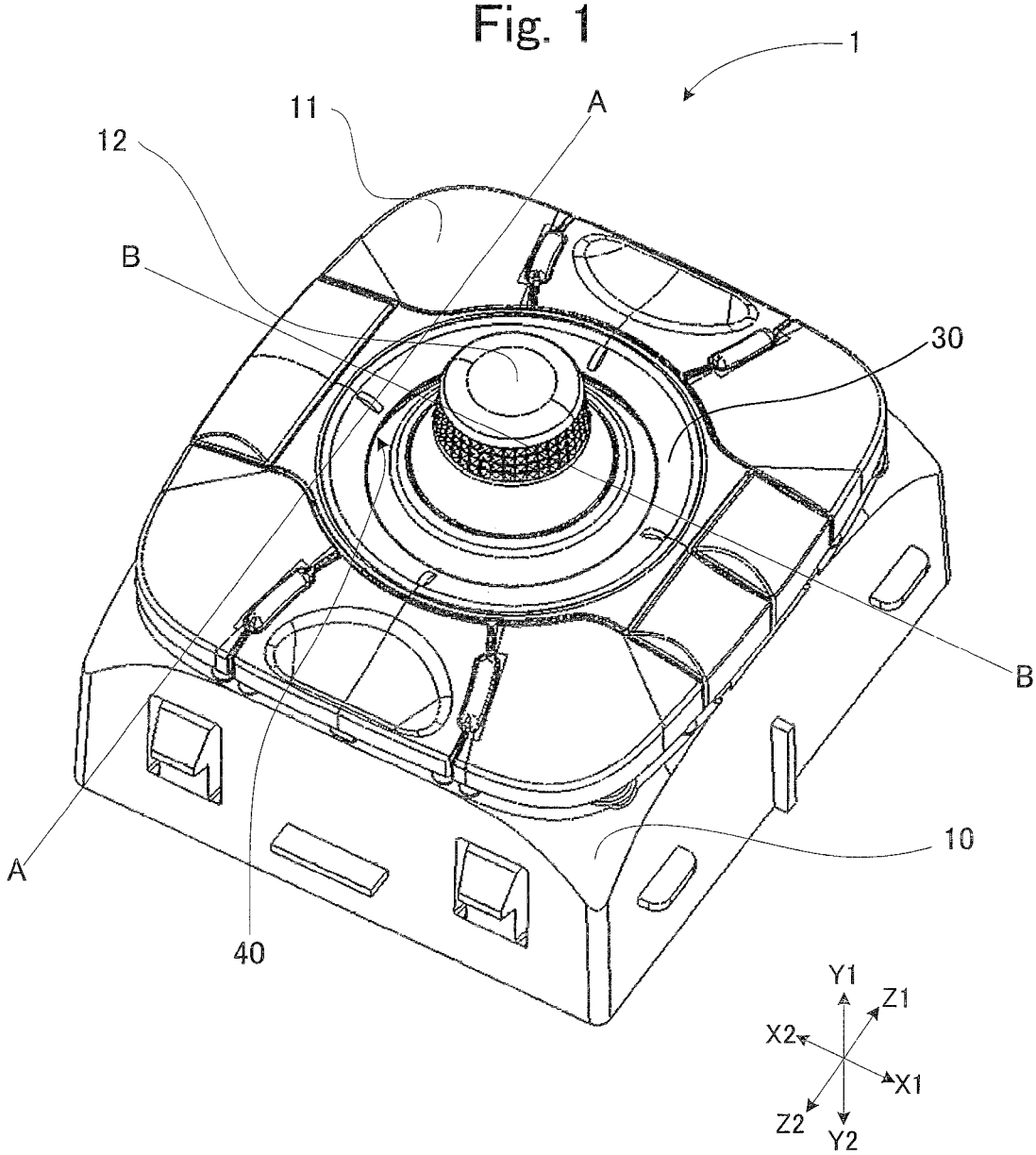
FIG. 1 is a perspective view showing an external appearance of an input device 1 according to one embodiment of the present invention.

An embodiment of the present invention will be described referring to the drawings. As an input device for an in-vehicle device, description of the present embodiment will take an example of an input device for a navigation system. Of course, an in-vehicle device is not limited to a navigation system, and may be an air conditioner or an audio system, for example.

Figure 2:
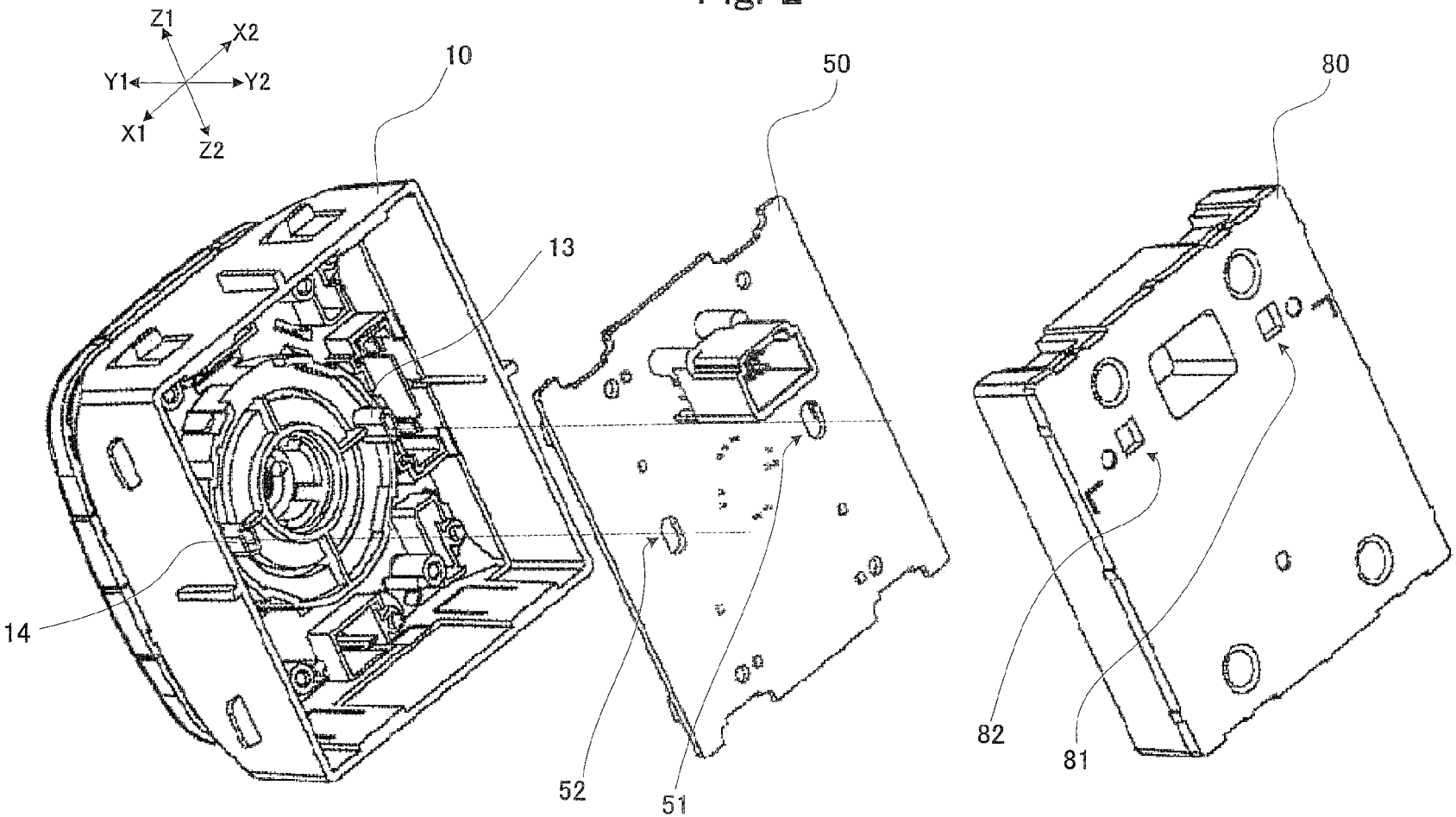
FIG. 2 is a perspective view showing a state in which the input device 1 has been disassembled into main parts.
Figure 3:
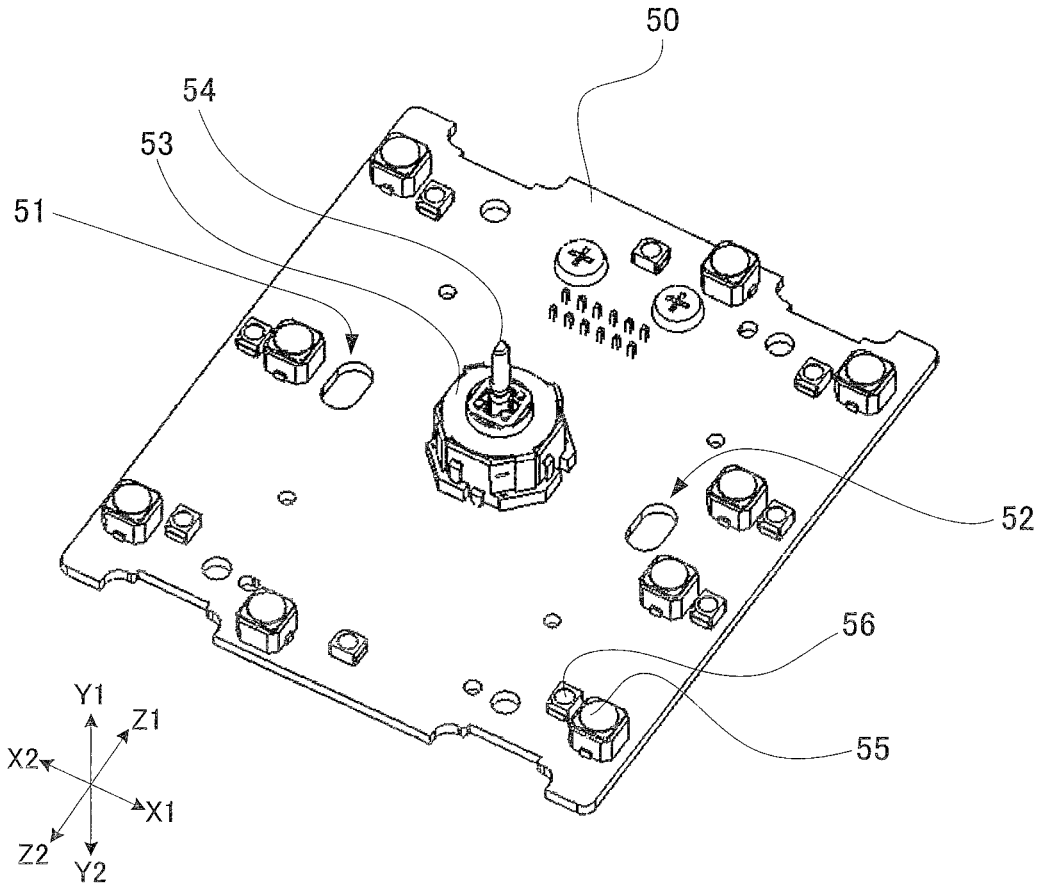
FIG. 3 is a perspective view showing an external appearance of a substrate 50 of the input device 1.
Figure 4:
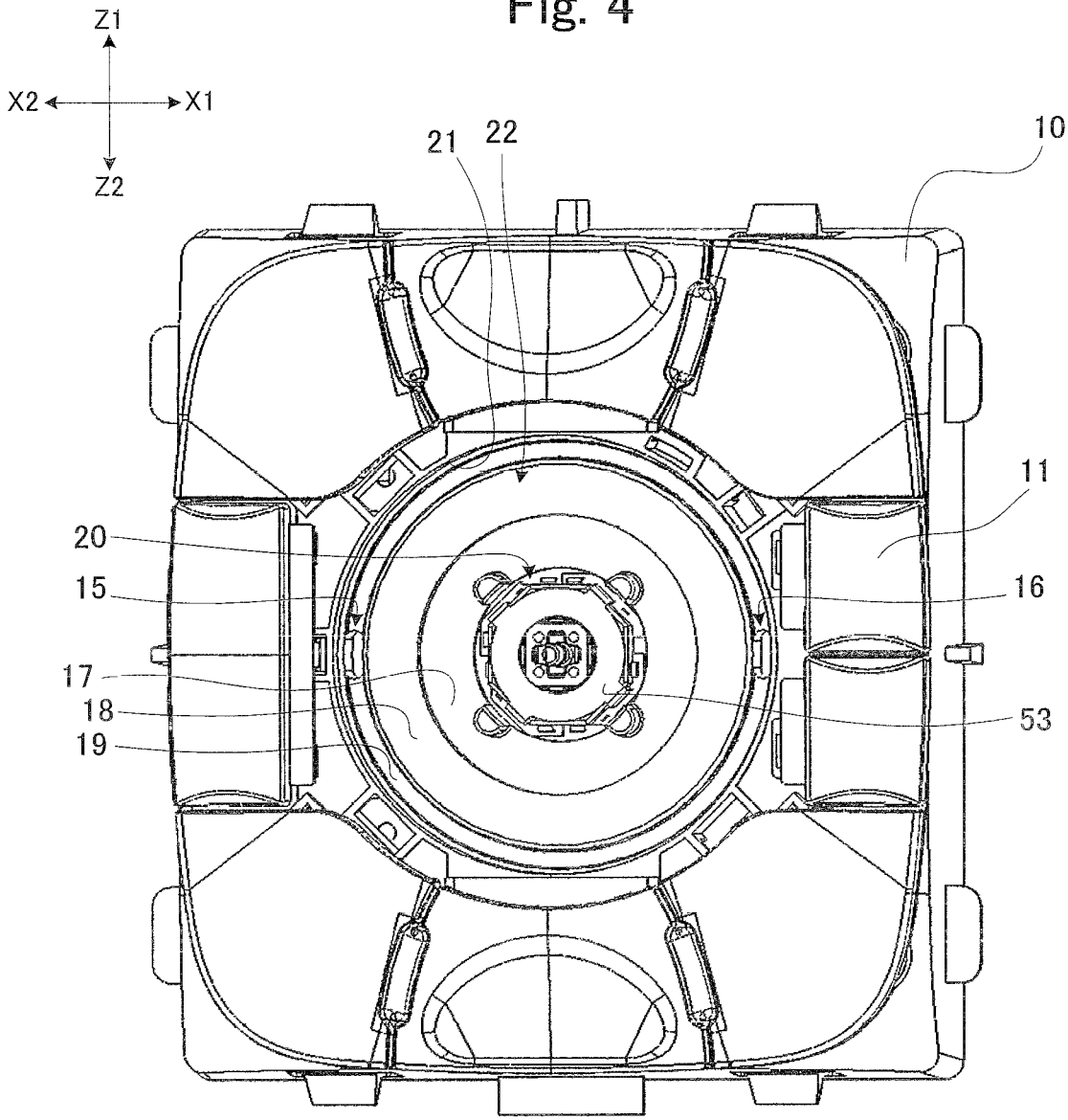
FIG. 4 is a perspective view showing an external appearance of the top side of the input device 1 (in a state that an operating knob has been removed)
Figure 5:
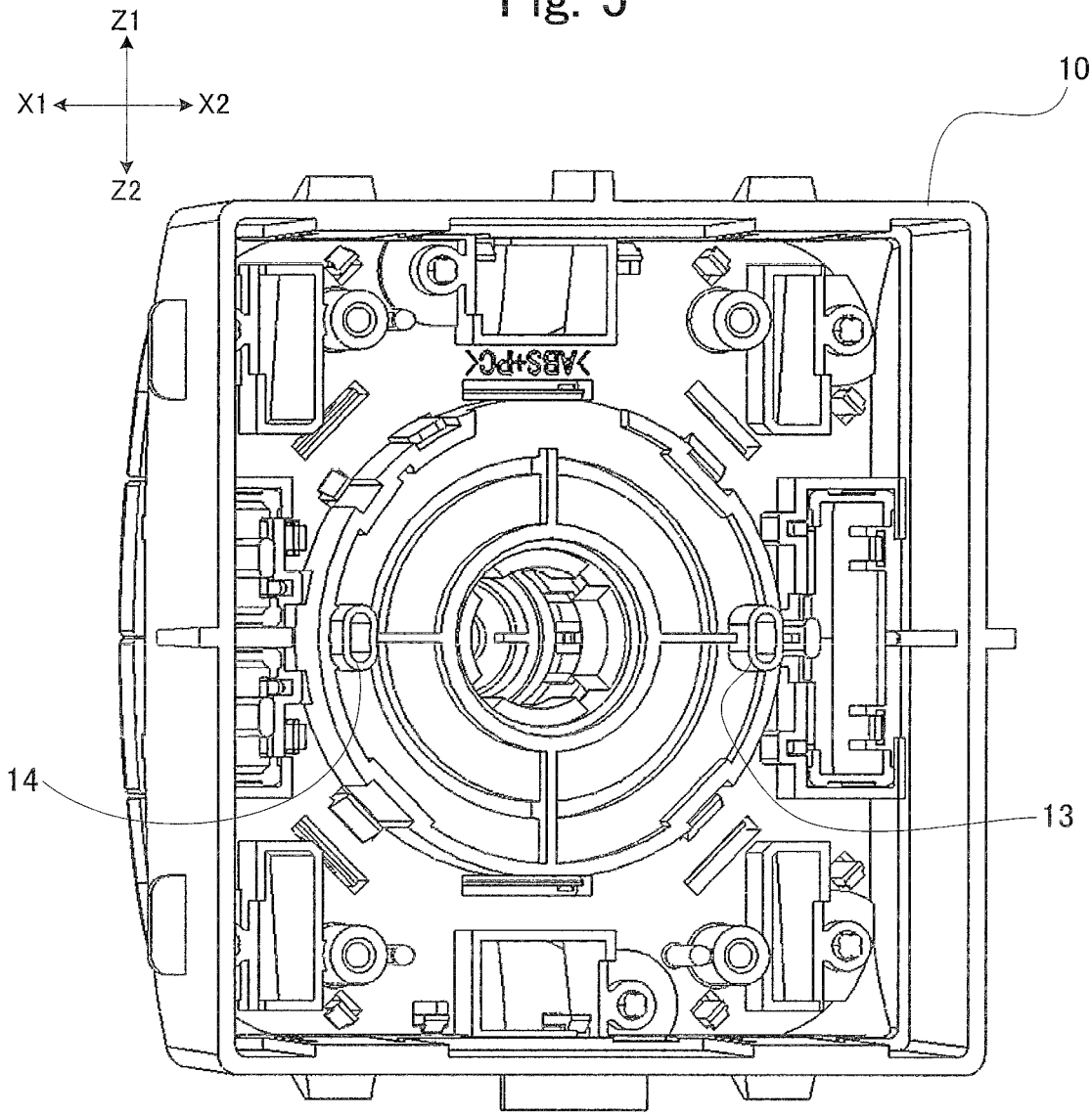
FIG. 5 is a perspective view showing an external appearance of the bottom side of the input device 1 (in a state that the substrate 50 and a housing 80 have been removed)
Figure 6:
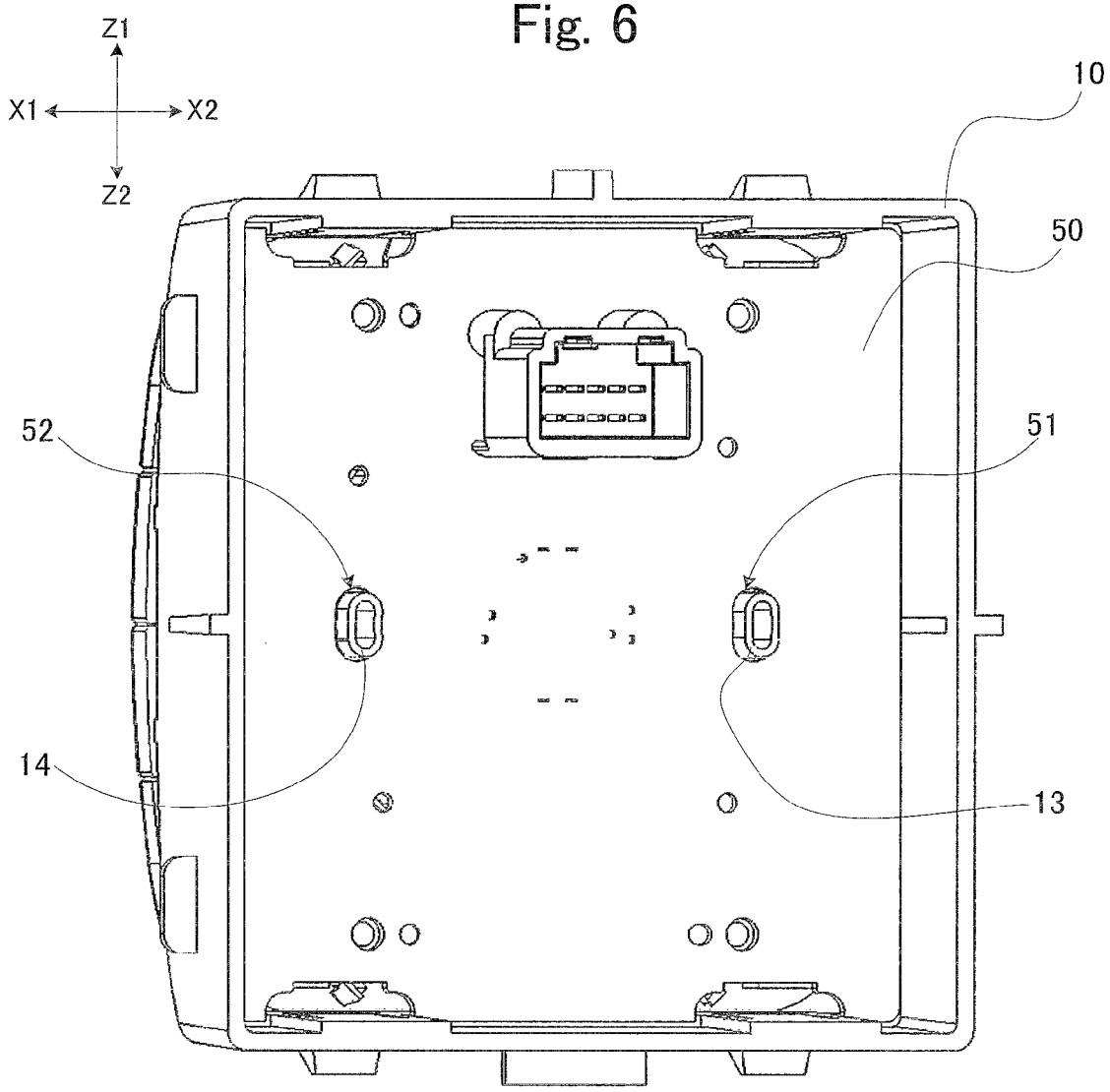
FIG. 6 is a perspective view showing an external appearance of the bottom side of the input device 1 (in a state that the housing 80 has been removed)
Figure 7:
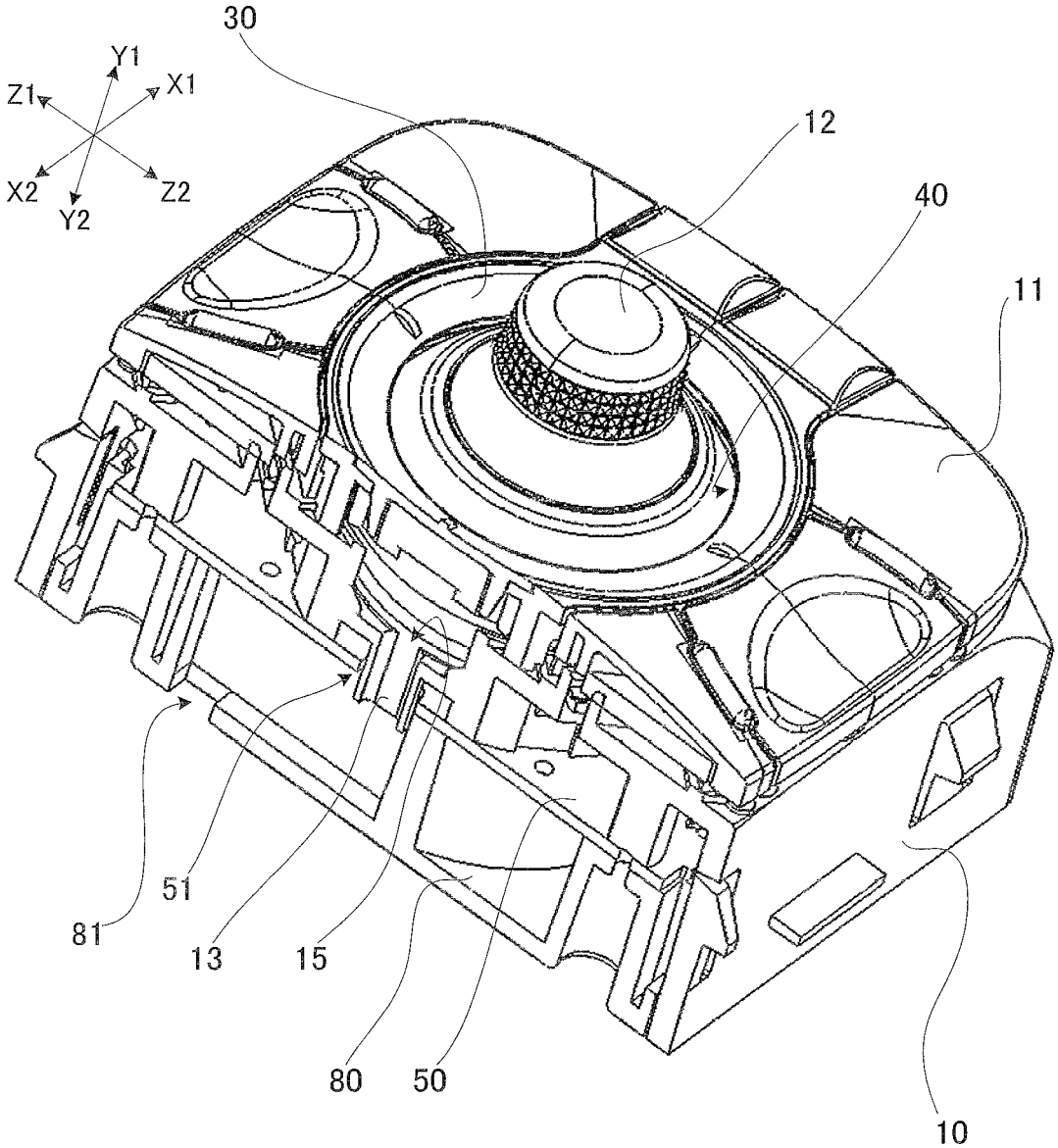
FIG. 7 is a perspective view showing a cross section (the cross section A in FIG. 1) of the input device 1.
Figure 8:
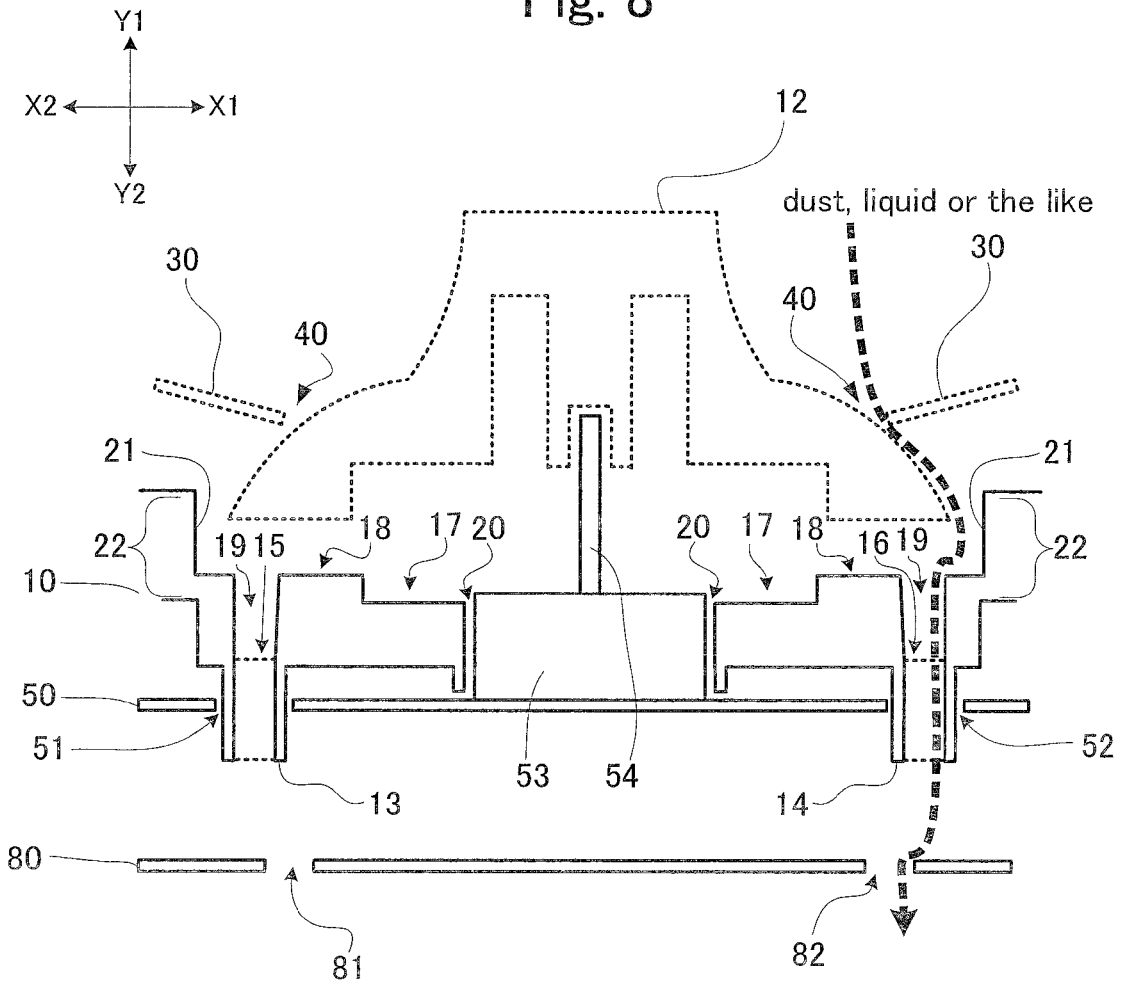
FIG. 8 is a view for explaining an outline of features of a cross section (the cross section B in FIG. 1) of the input device 1.

FIG. 1 is a perspective view showing an external appearance of the input device 1 of the present embodiment of the invention. FIG. 2 is a perspective view showing a state in which the input device 1 has been disassembled into main parts. FIG. 3 is a perspective view showing an external appearance of a substrate 50 of the input device 1. FIG. 4 is a perspective view showing an external appearance of the top side of the input device 1 (in a state that an operating knob has been removed). FIG. 5 is a perspective view showing an external appearance of the bottom side of the input device 1 (in a state that the substrate 50 and a housing 80 have been removed). FIG. 6 is a perspective view showing an external appearance of the bottom side of the input device 1 (in a state that the housing 80 has been removed). FIG. 7 is a perspective view showing a cross section (the cross section A in FIG. 1) of the input device 1. And, FIG. 8 is a view for explaining an outline of features of a cross section (the cross section B in FIG. 1) of the input device 1.

As shown in FIG. 1, the input device 1 comprises: a housing 10 having an operating portion (an operation surface) on its top side (the Y1 side); an operating knob 12 received in a receiving portion 22 (see FIGS. 4 and 8) in the center of the operating portion of the housing 10; and a plurality of push buttons 11 arranged around the receiving portion 22. Further, the input device 1 is fitted with a ring member 30 around the receiving portion 22 in order to prevent the operating knob 12 from coming off toward the upward direction (the Y1 direction). Between the operating knob 12 and the ring member 30, there is a clearance 40 along the periphery of the operating knob 12 so as to allow rotation and titling movements of the operating knob 12.

As shown in FIG. 2, the substrate 50 (See FIG. 3) provided with input sensing elements and LEDs is set in the housing (front housing) 10. And the bottom side (the Y2 side) of the front housing 10 is closed by another housing (rear housing) 80.

As shown in FIG. 3, the substrate 50 has on its top side (the Y1 side): a multiple switch 53 as an input sensing element for detecting a plurality of operations such as directing, turning and pushing-down operations; a multiple switch rod 54 for connecting the multiple switch 53 and the operating knob 12; tact switches 55 and LEDs 56 arranged at respective positions corresponding to the push buttons 11.

The input device 1 of the present embodiment is connected to the main body of the navigation system through cable or the like. And, the input device 1 is installed for example between two front seats in a vehicle in a state that its operating portion (the Y1 side) faces the ceiling of the vehicle. Further, the input device 1 is installed at an incline of a prescribed angle so that a side at one end (on the X2 side) of the bottom (the Y2 side) of the housing 80 becomes slightly higher than the side of the opposite end (on the X1 side) of the housing 80 (in other words, so that the operating portion slants upward in the anterior direction of the vehicle). As a result, liquid or dust easily falls upon the top surface (the Y1 side). And, water or dust easily permeates a gap between push buttons 11 or the gap (the clearance 40) between the operating knob and the housing 10. Thus, as described below, the input device 1 has structure for preventing liquid and dust from reaching the substrate 50.

FIGS. 4 and 8 show a state that the ring member 30 is removed from the housing 10 of the input device 1 and the operating knob 12 is removed from the multiple switch rod 54.

As shown in FIGS. 4 and 8, the receiving portion 22 of a cylindrical shape for receiving the operating knob 12 is formed in the top side (the Y1 side) of the housing 10. The receiving portion 22 is formed by a bottom (on the Y1 side) of a circular shape and a side wall 21 on the periphery of the bottom. In the center of the bottom of the receiving portion 22, is formed a multiple switch hole 20 through which the multiple switch 53 is inserted upwardly (in the Y1 direction) from below (the Y2 side). Further, in the bottom of the receiving portion 22, are formed a ring-shaped face 17, a ring-shaped face 18 that is above (in the Y1 direction) the height of the ring-shaped face 17, and a ring-shaped drain 19 whose bottom is under the height of the face 17.

Further, in the drain 19, drain holes 15 and 16 having a prescribed size are formed respectively at prescribed positions of the bottom of the drain 19. The drain holes 15 and 16 are coupled respectively to drainpipes 13 and 14 extending downwardly (in the Y2 direction). The drainpipes 13 and 14 pass through respective drainpipe holes 51 and 52 of the substrate 50 fitted to the housing 10.

As shown in FIGS. 2 and 3, 6-8, in the substrate 50, are formed the drainpipe holes 51 and 52 through which the respective drainpipes 13 and 14 of the housing 10 pass. Further, the housing 80 has on its bottom side (the Y2 side) drain holes 81 and 82 leading to the outside.

Here, the case will be considered where, as described above, the input device is installed in a vehicle in such a way that a side at one end (on the X2 side) of the bottom (the Y2 side) of the housing 80 becomes slightly higher than the side of the opposite end (on the X1 side) of the housing 80. In that case, the drain hole 16 is formed at a position that becomes lowest in the bottom of the drain 19. As a result, liquid or dust falling upon the operation surface of the input device 1 permeates the clearance 40 along the surface of the operating knob 12 to reach the inside of the receiving portion 22 and then the drain 19. Then, due to gravity, most of the liquid or dust collected in the drain 19 flows in the ring-shaped drain 19 toward the drain hole 16. Then, the liquid or dust passes the substrate 50 through the drain hole 16 and the drainpipe 14, and flows into the housing 80. Eventually, the liquid or dust is discharged to the outside of the input device 1 through the drain hole 82 of the housing 80.

Hereinabove, one embodiment of the present invention has been described. According to this embodiment, in an input device for an in-vehicle device, it is possible to prevent permeation of liquid and dust to electronic parts within the housing more effectively. And thus, it is possible to reduce possibility of failures due to liquid or dust.

That is to say, in this embodiment, the drain holes are formed in the top side of the housing of the input device, and the drainpipe holes through which the drainpipes pass downward are formed in the substrate fitted in the inside of the housing. Further, the drain holes leading to the outside are formed in the housing at positions lower than the substrate. As a result, it is possible to reduce, to the greater extent, possibility that liquid or dust entering from the top side of the housing reaches electronic parts.

Further, in the present embodiment, the drain is formed in the top side of the housing of the input device, and the drain holes are formed in the bottom of the drain. As a result, liquid or dust entering from the top side of the housing is collected first in the drain, and thus easily led to the drain holes. Further, even if liquid or dust enters from a location distant from the drain holes, the liquid or dust led to the drain holes along the drain. Thus, it is possible to reduce, to the greater extent, possibility that liquid or dust entering from the top side of the housing reaches electronic parts.

Further, in the present embodiment, the drain holes are formed at positions such that some position becomes lower when the input device is installed at its installation position determined previously by its product specification. As a result, liquid or dust collected first in the drain is more easily led by gravity to the drain holes. Thus, it is possible to reduce, to the greater extent, possibility that liquid or dust entering from the top side of the housing reaches electronic parts.

The above-described embodiment of the present invention is intended to illustrate and not to limit the gist and scope of the present invention. Many alternatives, modifications and variations of the present invention are apparent to persons skilled in the art.

For example, as for the number of the drain hole and the drainpipe, a couple of drain hole and drainpipe may be formed, or three or more couples of drain holes and drainpipes may be formed. Further, similarly to the case of two couples, those couples may be formed such that positions of at least one couple become lower when the input device is installed at its installation position determined previously by its product specification. Further, a plurality of drains may be formed. In this case, for each drain, positions of drain holes and drain pipes can be determined as in the above case. Further, sizes, lengths and the like of the drain holes and drainpipes are not limited to those described above.

Further, the position at which the drain is formed is not limited to the receiving portion for the operating knob. Also, the shape of the drain is not limited to the ring shape. For example, the drain may be formed under the receiving portion for the push buttons. In this case, the shape of the drain may be a shape following the shape of the gap (clearance) between push buttons.

Further, the positions, sizes, number, shapes and the like of the drain holes leading to the outside are not those described above. For example, the positions of the drain holes leading to the outside may be the side of the housing as far as the positions are under the substrate. Further, at least one drain hole leading to the outside may be formed at a position that becomes lower when the input device is installed at its installation position determined previously by its production specification.

1: input device; 10: housing; 11: push button; 12: operating knob; 13: drainpipe; 14: drainpipe; 15: drain hole; 16: drain hole; 17: face; 18: face; 19: drain; 20: multiple switch hole; 21: side wall; 22: receiving portion; 30: ring member; 40: clearance; 50: substrate; 51: drainpipe hole; 52: drainpipe hole; 53: multiple switch; 54: multiple switch rod; 55: tact switch; 56: LED; 80: housing; 81: drain hole; and 82: drain hole.

The invention claimed is:

1. An input device comprising:

an operating member arranged to a substrate; and a housing having an external surface on an external side and an internal surface on an internal side, wherein:

a receiving recess is formed on the external surface of the housing, the receiving recess being defined by at least a bottom surface and a side surface on the periphery of the bottom surface;

an operative member hole is formed in the housing at a predetermined position in the receiving recess to connect the external side and the internal side of the housing;

the substrate is arranged on the internal side of the housing such that the operating member passes through the operative member hole;

a drainage recess is formed on the bottom surface of the receiving recess, the drainage recess having a shape that corresponds to a gap between the operating member and the side surface of the receiving recess; and a housing drain hole is formed at a predetermined location in the drainage recess to connect the drainage recess and the internal side of the housing.

2. The input device according to claim 1, wherein the predetermined location in the drainage recess at which the housing drain hole is formed is a lowest location of the drainage recess in a plumb line direction.

3. The input device according to claim 1, further comprising the substrate.

4. The input device according to claim 3, wherein:

a substrate drain hole is formed in the substrate, and the housing includes a drain pipe extending from the internal surface of the housing to pass through the substrate drain hole, the drain pipe connecting the housing drain hole and the internal side of the housing.

5. The input device according to claim 1, wherein the operating member comprises:

an operating knob for receiving a user command of at least one operation; and a multiple switch for detecting the at least one operation received by the operating knob.

6. The input device according to claim 5, wherein the shape of the drainage recess follows the shape of the gap between the operating knob of the operating member and the side surface of the receiving recess.

* * * * *